United States Patent [19]

Savas

[11] 4,284,429

[45] Aug. 18, 1981

[54] ALUMINUM BASE CASTING ALLOY

[76] Inventor: John Savas, 9710 Brecksville Rd., Brecksville, Ohio 44141

[21] Appl. No.: 113,824

[22] Filed: Jan. 21, 1980

[51] Int. Cl.[3] ..... C22C 21/02

[52] U.S. Cl. ..... 75/141; 75/140; 148/32.5; 148/159

[58] Field of Search ..... 75/141, 146, 140; 148/32, 32.5, 159

[56] References Cited

U.S. PATENT DOCUMENTS 3,901,691 8/1975 Sanders et al. ..... 75/141

*Primary Examiner*—Richard O. Dean

[57] ABSTRACT

This invention relates to high silicon, aluminum base, casting alloys having high strength in the as-cast and room temperature aged condition. The alloys of the preferred composition ranges are similar to the F-132 permanent mold, aluminum piston alloy, containing 9.5% silicon, 3.0% Cu, and 1.0% Mg, except that the Mg has been increased to about 3.0%, and Zn has been added to about 5.5%.

The addition of the Mg and Zn results in their room temperature aging characteristics, to Brinell hardnesses of between 95 and 120. These hardnesses are comparable to those of the F132 alloy, 100 to 110 BHN, when heat treated at 400 F for from 7 to 9 hours. In addition, the alloys of the invention exhibit a minimum of growth during the hardening cycle, whereas the presently used high silicon alloys exhibit growth rates of 0.001" per inch, and greater, during their heat treatment cycles.

7 Claims, No Drawings

ALUMINUM BASE CASTING ALLOY

BACKGROUND OF THE INVENTION

High silicon, aluminum alloys of various compositions are normally used in permanent mold or die casting applications, although some are also used for sand casting. Silicon contents may vary from 2.0% to 22.0% in the various alloys cast into dies, but normally these alloys contain between 5.0% and 12.0% silicon. The aluminum alloys of the new invention, therefore, would in their broadest conception, include the following elements in the ranges indicated:

| Si | Cu | Mg | Zn | Fe | Mn | Ni | Ti | Cr | Others |
|---|---|---|---|---|---|---|---|---|---|
| 5.0 | .50 | 1.5 | 2.0 | 1.35 | .65 | .50 | .20 | .15 | .15 |
| 22.0 | 7.00 | 5.5 | 8.0 | max. | max. | max. | max. | max. | max. |

For economic and other considerations such as casting quality, aging characteristics, hardness, growth, high temperature strength, etc., the following narrower ranges of composition would more aptly describe the alloys of the new invention:

| Si | Cu | Mg | Zn | Fe | Mn | Ni | Ti | Cr | Others |
|---|---|---|---|---|---|---|---|---|---|
| 7.0 | 2.0 | 2.0 | 3.5 | 1.20 | .50 | .35 | .15 | .10 | .10 |
| 12.0 | 4.0 | 4.0 | 6.5 | max. | max. | max. | max. | max. | max. |

In the preferred embodiment of the invention, which results in strength properties similar to the F132 alloy, but without heat treatment, the following alloy ranges and aim composition would typify the invention:

| Si | Cu | Mg | Zn | Fe | Mn | Ni | Ti | Cr | Others |
|---|---|---|---|---|---|---|---|---|---|
| 8.5 | 2.5 | 2.5 | 4.5 | 1.00 | .35 | .20 | .10 | .05 | .10 |
| 10.5 | 3.5 | 3.5 | 6.0 | max. | max. | max. | max. | max. | max. |
| 9.5 | 3.0 | 3.0 | 5.5 | max. | max. | max. | max. | max. | max. |

Prior art alloys with high Si contents, such as the F132 piston alloys with 9.5% Si, exhibit considerable growth, as much as 0.001" per inch or more, during heat treatment in the temperature range of 300° F. to 500° F. for from 2 to 26 hours, depending on the aging treatment which is specified. Other Si-Cu alloys of aluminum, such as the 108 alloy, also exhibit significant growth of up to 0.001" per inch or greater, depending on the aging temperature and times at temperature.

For a preferred alloy of the invention, with about 9.0% Si, 3.0% Cu, 3.5% Mg, and 5.5% Zn, which ages at room temperature to a hardness level of about 100 to 115 BHN, another novel feature of this invention is that the growth is very minimal, or about 0.0004" per inch or less, and even this growth was observed only after tempering at 400° F. for 10 hours. No growth was observed during room temperature aging. Typical compositions, hardness checks, and growth measurements for two typical alloys within the preferred composition ranges are included in Table I.

The data in Table I show that the higher (3.5%) Mg alloy develops slightly higher hardnesses than the lower (2.7%) Mg alloy. In general, the more rapidly cooled, thin, ascast wafer material room temperature aged to higher hardnesses than did the larger, as-cast, 3½ diameter rounds, which were also considerably thicker than the wafers.

TABLE I

| TYPICAL PREFFERED ALLOY COMPOSITIONS | Mg | Zn | Mn | Si | Cu | Fe | Ni | Ti | Cr | Sn | Pb |
|---|---|---|---|---|---|---|---|---|---|---|---|
| Low Mg | 2.70 | 5.70 | .22 | 9.35 | 2.90 | .83 | .04 | .06 | .04 | .04 | .06 |
| High Mg | 3.50 | 5.50 | .22 | 8.95 | 2.90 | .83 | .04 | .06 | .04 | .04 | .06 |

| TYPICAL HARDNESS CHECKS* (For Above Compositions) | As Cast | Room Temperature Aged (hrs) 3 | 17 | 24 | 37 | >90** |
|---|---|---|---|---|---|---|
| Wafers | | | | | | |
| Low Mg | 92 | 104 | 106 | 109 | 114 | 110 |
| | 101 | 109 | 109 | 114 | 118 | 115 |
| High Mg | 94 | 109 | 109 | 111 | 116 | 115 |
| | 101 | 111 | 114 | 118 | 122 | 118 |
| 3½" Rounds | | | | | | |
| Low Mg | 86 | 91 | 94 | 101 | 105 | 104 |
| | 101 | 106 | 106 | 109 | 115 | 110 |
| High Mg | 94 | 97 | 97 | 104 | 108 | 105 |
| | 101 | 106 | 106 | 111 | 115 | 110 |

| GROWTH MEASUREMENTS (Outside Diameter) | | | | | | |
|---|---|---|---|---|---|---|
| 3½" Rounds | | | | | | |
| Low Mg | 3.544 | 3.544 | 3.544 | 3.544 | 3.544 | 3.546** |
| High Mg | 3.601 | 3.601 | 3.601 | 3.601 | 3.601 | 3.602** |

*Converted to Brinell (BHN) from Rockwell "E" and/or Rockwell "B".
**After Aging at 400 F. (10 hours).

The data in Table I also show that the growth (0.001" per 3½") of the higher Mg alloy was less than that of the lower Mg alloy (0.002" per 3½"), but this was only evidenced after aging at 400° F. for 10 hours after room temperature aging for more than 90 hours without growth. The cost of the alloying elements at any particular time, and the particular mechanical and physical properties required in the parts to be cast, will determine the particular ranges of the alloying elements to be used in any particular application of the aluminum alloys of this invention within either the broad, narrow, or preferred ranges as outlined above and by the claims, as follow.

What is claimed:

1. An aluminum casting alloy consisting essentially of 5.0% to 22.0% silicon, 0.5 to 7.0% copper, 1.5 to 5.5% magnesium, 2.0 to 8.0% zinc, iron not over 1.35%, manganese not over 0.65%, nickel not over 0.50%, titanium not over 0.20%, and chromium and other residual elements not over 0.15%, balance aluminum.

2. An aluminum casting alloy according to claim 1 which is characterized by age hardening at room temperature to hardnesses in the range of Brinell 95 to 120.

3. An aluminum casting alloy according to claim 1 which is characterized by negligible growth characteristics during room temperature aging, and even minimum growth after heat treatment at 400° F. for up to 10 hours, as compared to other high silicon casting alloys.

4. An aluminum casting alloy according to claim 1, in which silicon is in the range of 7.0 to 12.0%, copper is 2.0 to 4.0%, magnesium is 2.0 to 4.0%, zinc is 3.5 to 6.5%, with iron not over 1.20%, manganese not over 0.50%, nickel not over 0.35%, titanium not over 0.15%, and chromium and other residual elements are not over 0.10%.

5. An aluminum casting alloy according to claim 4 which is characterized by age hardening at room temperature to hardnesses in the range of Brinell 95 to 120, and exhibiting minimum growth characteristics during room temperature aging.

6. An aluminum casting alloy according to claim 1, consisting of a preferred composition of 8.5 to 10.5% silicon, 2.5 to 3.5% copper, 2.5 to 3.5% magnesium, 4.5 to 6.0% zinc, with iron not over 1.00%, manganese not over 0.35%, nickel not over 0.20% titanium not over 0.10%, chromium not over 0.05%, and other residuel elements not over 0.10%.

7. An aluminum casting alloy according to claim 6, characterized by room temperature aging to hardnesses in the range of Brinell 95 to 120, virtually no growth during room temperature aging for up to 90 hours, and minimal growth of less than 0.0006" per inch after heat treatment at 400° F. for up to 10 hours.

* * * * *